US007334381B2

(12) United States Patent
Mertz, II et al.

(10) Patent No.: US 7,334,381 B2
(45) Date of Patent: Feb. 26, 2008

(54) METHOD AND APPARATUS FOR PACKAGING PANEL PRODUCTS

(75) Inventors: William James Mertz, II, Greensberg, PA (US); Scott Michael Miller, Youngwood, PA (US); Robert James Reynolds, Jr., Leasberg, NC (US); Timothy Wayne Harville, Danville, VA (US); Melvin Gilbert Shumate, Danville, VA (US); Christopher Wayne Clark, Danville, VA (US); James Carroll Holt, Danville, VA (US)

(73) Assignee: The Real Reel Corporation, East Providence, RI (US)

( * ) Notice: Subject to any disclaimer, the term of this patent is extended or adjusted under 35 U.S.C. 154(b) by 0 days.

(21) Appl. No.: 11/679,210

(22) Filed: Feb. 27, 2007

(65) Prior Publication Data

US 2007/0157558 A1 Jul. 12, 2007

Related U.S. Application Data

(62) Division of application No. 10/962,068, filed on Oct. 8, 2004, now Pat. No. 7,204,070.

(60) Provisional application No. 60/510,647, filed on Oct. 10, 2003.

(51) Int. Cl.
*B65B 11/00* (2006.01)
*B65B 13/02* (2006.01)

(52) U.S. Cl. ..... 53/397; 53/399; 53/447; 53/472

(58) Field of Classification Search ..... 53/397, 53/414, 449, 462, 472, 504, 582, 590, 170, 53/174, 175, 139.5, 399, 139.7, 176
See application file for complete search history.

(56) References Cited

U.S. PATENT DOCUMENTS

| | | | |
|---|---|---|---|
| 3,626,660 | A | 12/1971 | Dorfmann |
| 3,698,152 | A | 10/1972 | Reed |
| 3,720,035 | A | 3/1973 | Rutter |
| 4,162,729 | A | 7/1979 | Kaiser et al. |
| 4,265,069 | A | 5/1981 | Heaney |
| 4,583,639 | A | 4/1986 | Fedick et al. |
| 4,627,223 | A | 12/1986 | Janhonen |
| 4,700,844 | A | 10/1987 | Griffith |
| 4,757,666 | A | 7/1988 | Janhonen |
| 4,784,269 | A | 11/1988 | Griffith |
| 4,865,200 | A | 9/1989 | Sullivan et al. |
| 4,956,961 | A | 9/1990 | Janhonen |

(Continued)

*Primary Examiner*—Louis Huynh
(74) *Attorney, Agent, or Firm*—Barlow, Josephs & Holmes, Ltd.

(57) ABSTRACT

A system for packaging a flat panel product includes a dispensing device for dispensing a length of inner protective packaging material, a folding table for wrapping the inner protective packaging material around the product and folding an outer protective packaging material around the product, and a binding device for binding the outer packaging material, inner packaging material, and product together, suspending the product relative to at least one of the walls of the sidewall and supporting the product laterally. A data entry device provides data related to the length of inner protective packaging material required, and this data is fed to a controller, which controls the dispensing device to provide an appropriate length of material. The data entry device can also provide shipping information, fed to a printer for printing a shipping label.

16 Claims, 9 Drawing Sheets

U.S. PATENT DOCUMENTS 5,386,911 A 2/1995 Payne
5,513,478 A 5/1996 Abt
5,549,202 A * 8/1996 Whiteside ..... 53/399
5,607,056 A * 3/1997 Whiteside ..... 53/399
6,082,254 A * 7/2000 De Vlaam ..... 53/582
6,120,628 A * 9/2000 Pritelli ..... 156/64
6,276,526 B1 * 8/2001 Miller et al. ..... 206/321
6,363,690 B1 * 4/2002 Lay et al. ..... 53/504
6,938,397 B2 9/2005 Miller
7,204,070 B2 4/2007 Mertz, II et al.

* cited by examiner

METHOD AND APPARATUS FOR PACKAGING PANEL PRODUCTS

CROSS-REFERENCE TO RELATED APPLICATION

This application is a division of U.S. patent application Ser. No. 10/962,068, Oct. 8, 2004 now issued as U.S. Pat. No. 7,204,070, which claims priority to earlier filed U.S. Provisional Application No. 60/510,647, filed Oct. 10, 2003, the contents of which are incorporated herein by reference.

STATEMENT REGARDING FEDERALLY SPONSORED RESEARCH OR DEVELOPMENT

Not applicable.

BACKGROUND OF THE INVENTION

The present invention is related to methods for packaging products for shipping, and more particularly to methods and apparatuses for packaging panel products for shipment.

Products which are generally narrow in depth and formed in a sheet, plate or panel construction such as doors, windows, mirrors, and raw sheet materials including glass, plastic, stone, and various composite materials can be difficult to package and ship as they are prone to damage when dropped, particularly when dropped on their corners or edges. These types of products, referred to hereafter generally as "panel products" or "flat panel products" are typically packaged for shipping in an inner protective package enclosed in an outer shipping container. The inner protective package is typically constructed of a corrugated or paperboard material which is die cut to provide a pocket for receiving the product, and flaps which are folded over the product and taped or otherwise adhered to retain the product in position, and away from the edges of the package, during shipping. Prior to being positioned in the pocket, the product is typically wrapped in a poly, plastic or other scratch and/or liquid-resistant wrapping material to further protect the product during shipping. The outer packaging material is disposed around the inner package, enclosing the product and providing a location for placing shipping information on the package.

These prior art packaging methods while generally successful in protecting a product during shipment, are labor-intensive, time-consuming and ergonomically difficult for workers. These processes, for example, typically require a significant number of manual steps. Furthermore, to adequately protect the panel product provided within the package, each package must be individually sized to accept the particular product being shipped. Therefore, in production and packaging facilities where a number of different types of products are produced, an equivalent number of different types of shipping cartons must be stocked for packaging, requiring a great deal of storage space and inventory management. Also, the products must be assembled into the packaging entirely by hand, and the packaging process is therefore labor intensive, relatively expensive, and slow, often taking longer than the actual production. Additionally, the packaging is relatively heavy, thereby contributing to increased labor difficulties and expenses in shipping. Furthermore, damage to the internal products remains a problem when using these types of packages, contributing significantly to the cost of both the product and shipping.

SUMMARY OF THE INVENTION

The present invention provides a packaging system for packaging flat panel products including a data entry device, a dispensing device, a folding table, and a binding device. The data entry device receives data related to the size of a flat panel product to be packaged, and the dispensing device receives the size from the data entry device and dispenses a length of an inner protective wrapping material based on the size. A folding table receives a size-adjustable outer protective packaging material and provides a location for wrapping the flat panel product within the inner protective wrapping material and inside of the outer protective packaging material and, further, for adjusting the size of the outer protective packaging material. The binding device then seals the flat panel product within the outer protective packaging material.

In another aspect of the invention, a method for packaging a flat panel product is provided. The method comprises the steps of determining a size of the flat panel product, and, based on the size, selecting a size-adjustable outer protective material to enclose the flat panel product, and feeding a length of resilient material selected to circumvent an outer edge of the flat panel product. The resilient material is wrapped around the outer edge of the flat panel product, and the flat panel product is positioned within the outer protective material. The outer protective material is then adjusted to the size of the wrapped flat panel product; and folded around the product. A binder is then provided around the outer protective material to limit movement of the flat panel product within the inner and outer protective material during storage and shipping.

In yet another aspect of the invention, a packaging system for packaging flat panel products is provided. The packaging system includes a data entry device for receiving data related to the size of a flat panel product to be packaged, a dispensing device configured to receive the size from the data entry device and to dispense a length of a resilient edge protection material based on the size, a folding table, and a banding device. The folding table receives a size-adjustable outer protective packaging material and the wrapping material to provide a location for wrapping the flat panel product within the resilient edge protector and inside of the outer protective packaging material, and further for adjusting the size of the outer protective packaging material. To simplify the folding process, the folding table includes a backstop with a folding channel for folding the outer protective packaging. The banding device inserts bands in slots provided in the outer protective material to provide a binder around the circumference of the flat panel product within the outer protective packaging material.

DETAILED DESCRIPTION OF THE PREFERRED EMBODIMENT

Figure 1:
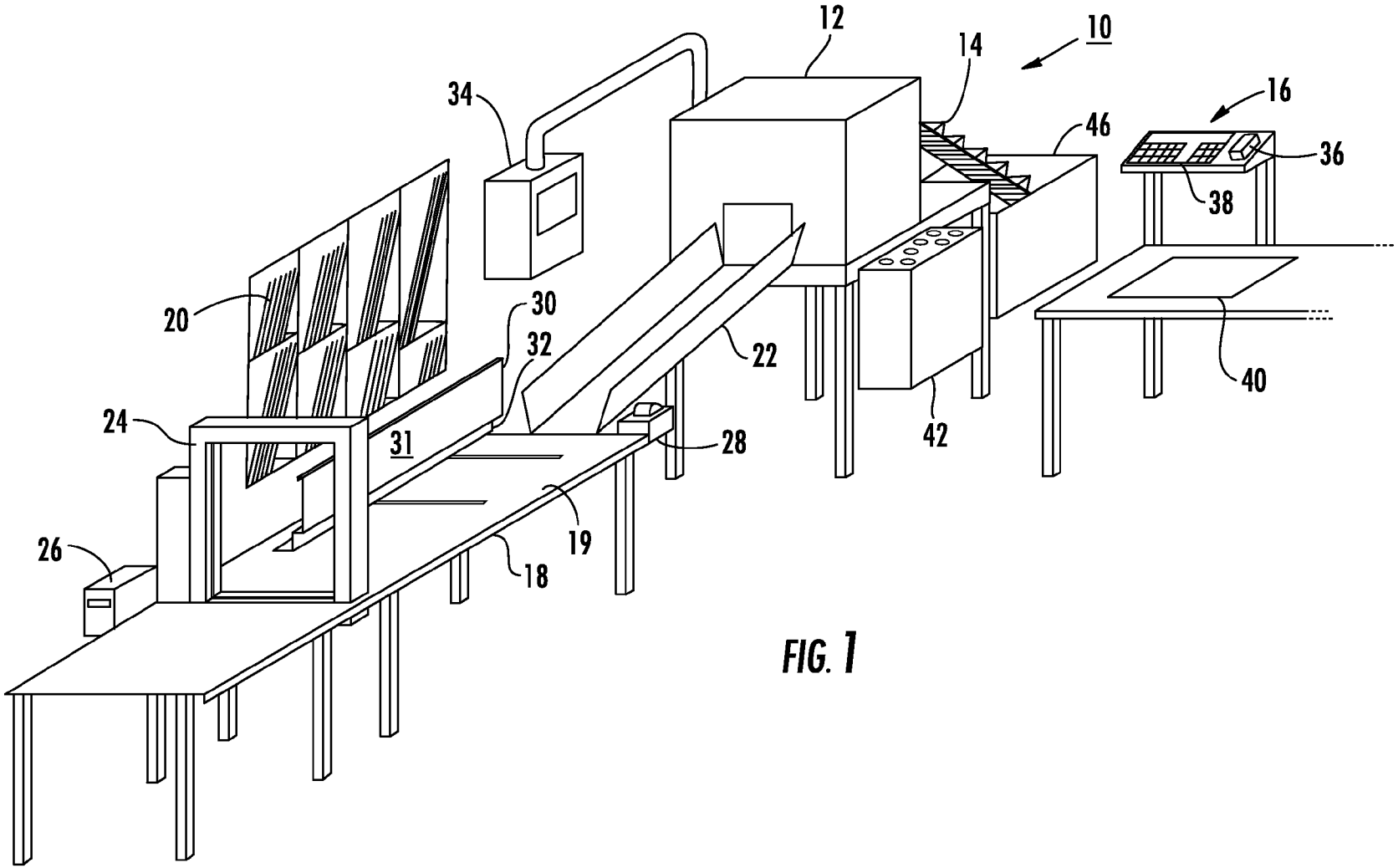
FIG. 1 is a perspective view of a packaging system constructed in accordance with the present invention.

Referring now to the figures and more particularly to FIG. 1, a packaging system 10 for packaging flat panel products in accordance with the present invention is shown. The packaging system 10 comprises a dispensing device 12 for dispensing an inner protective wrapping material 14. The wrapping material 14 is fed down a feed-out chute 22 to a folding table 18, where a size-adjustable outer protective packaging material 20 is provided for packaging the product 40. At the folding table 18, the product 40 is wrapped within the inner protective wrapping material 14 and the outer protective packaging material 20 is folded around the wrapped product 40. After the product is wrapped in the outer protective packaging material, it is directed to a binding device 24, which provides a binder coupling the outer protective packaging material 20 to the inner protective wrapping material 14 and the product 40. The binder supports the product 40 within the package and suspends the product 40 relative to one or more wall of the package, as described below.

Figure 2:
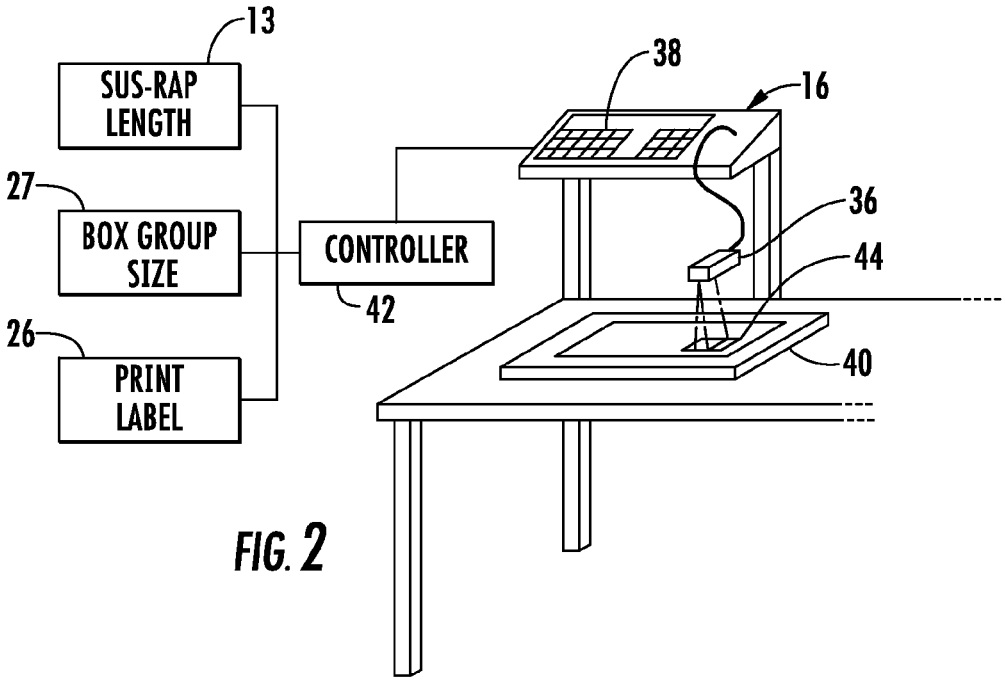
FIG. 2 is a partial block diagram of the control system of the packaging system of FIG. 1.

Referring still to FIG. 1 and also to FIG. 2, the packaging system 10 can include a data entry device 16 for providing data related to the product 40 to automate or simplify processes in the system. The data entry device 16 can include, for example, a barcode reader 36, a keyboard 38, and/or a touch-screen display 34 for entering data such as the size, shipping destination, and type of product 40. Information can be manually entered into the keyboard 38 or touch screen 34 or provided on a data label 44 which is scanned by the barcode reader 36 or similar scanning device. The data entry device 16 is connected to a controller 42 which determines an appropriate length 13 of inner protective wrapping material 14 based on the received size data and directs the dispensing device 12 to cut an appropriate length. The controller can further provide information on a display 34 for an operator to select a size-adjustable outer protective packaging material 20 of an appropriate size for the product 40 from a plurality of box group sizes 27. The controller 42 can be further linked to a shipping label printer 26 which, based on the data provided at the data entry device 16, can provide a shipping label directed to the customer for the packaged product 40. Each of these steps will be described more fully below.

Figure 3:
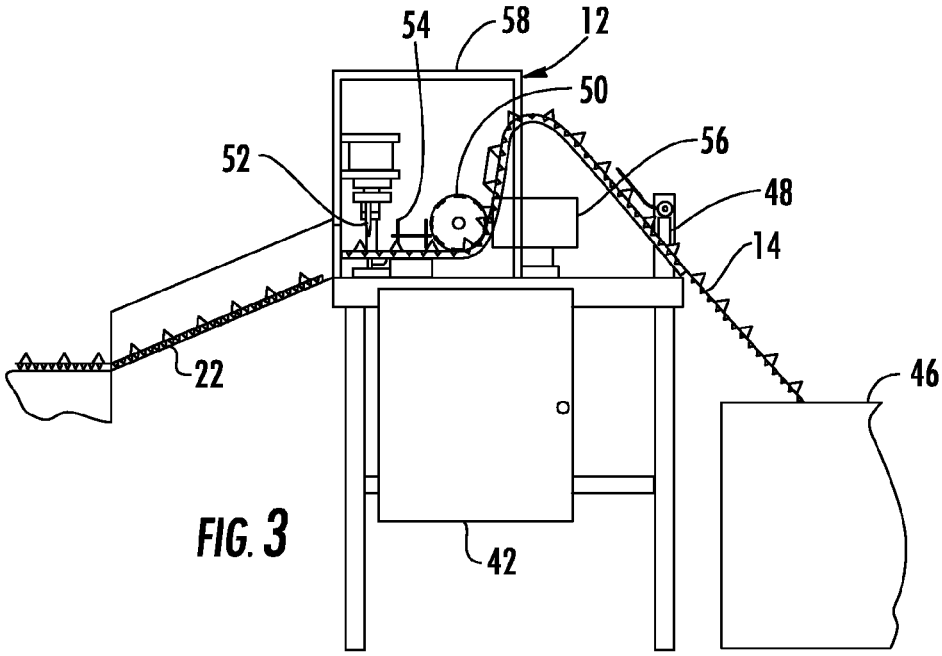
FIG. 3 is a side view of the dispensing device of FIG. 1.

Referring now to FIG. 3, the inner protective wrapping material 14 is provided in a continuous length in a container 46 and is fed from the container 46 to the dispensing device 12 through a feed wheel 50 and under a cutoff shear 52. The feed wheel 50, a brake motor 56, and the cutoff shear 52 are each controlled by the controller 42 which, as described above, receives size data from the data entry device 16, monitors the speed of the feed wheel 50 to determine a length dispersed, and controls the cutoff shear 52 to provide a selected length 13 of inner protective wrapping material 14 sized and dimensioned to protect an edge of the flat panel product 40. The sheared inner protective wrapping 14 is directed down the feed-out chute 22 to the folding table 18. To assure a smooth feed and continuous operation, and for providing a signal to the controller 42 when the container 46 of inner protective wrapping material has run out or otherwise stops feeding the dispensing device 12 includes a sensor 48 for sensing the presence of the inner protective wrapping material 14 at the input. A jam detector 54 is also provided for determining whether the inner protective wrapping material 14 is being fed continuously from the container 46 through the feed wheel 50, or whether the feed has been stopped or jammed. A cover 58 is provided over the feed wheel 50 and other active components including the cutoff shear 52 of the dispensing device 12 to prevent access by operators. The cover 58 is preferably locked to prevent access by the operator and to selectively allow access by maintenance personnel. Various methods for locking the cover 58 will be apparent to those of ordinary skill in the art.

Figure 4:
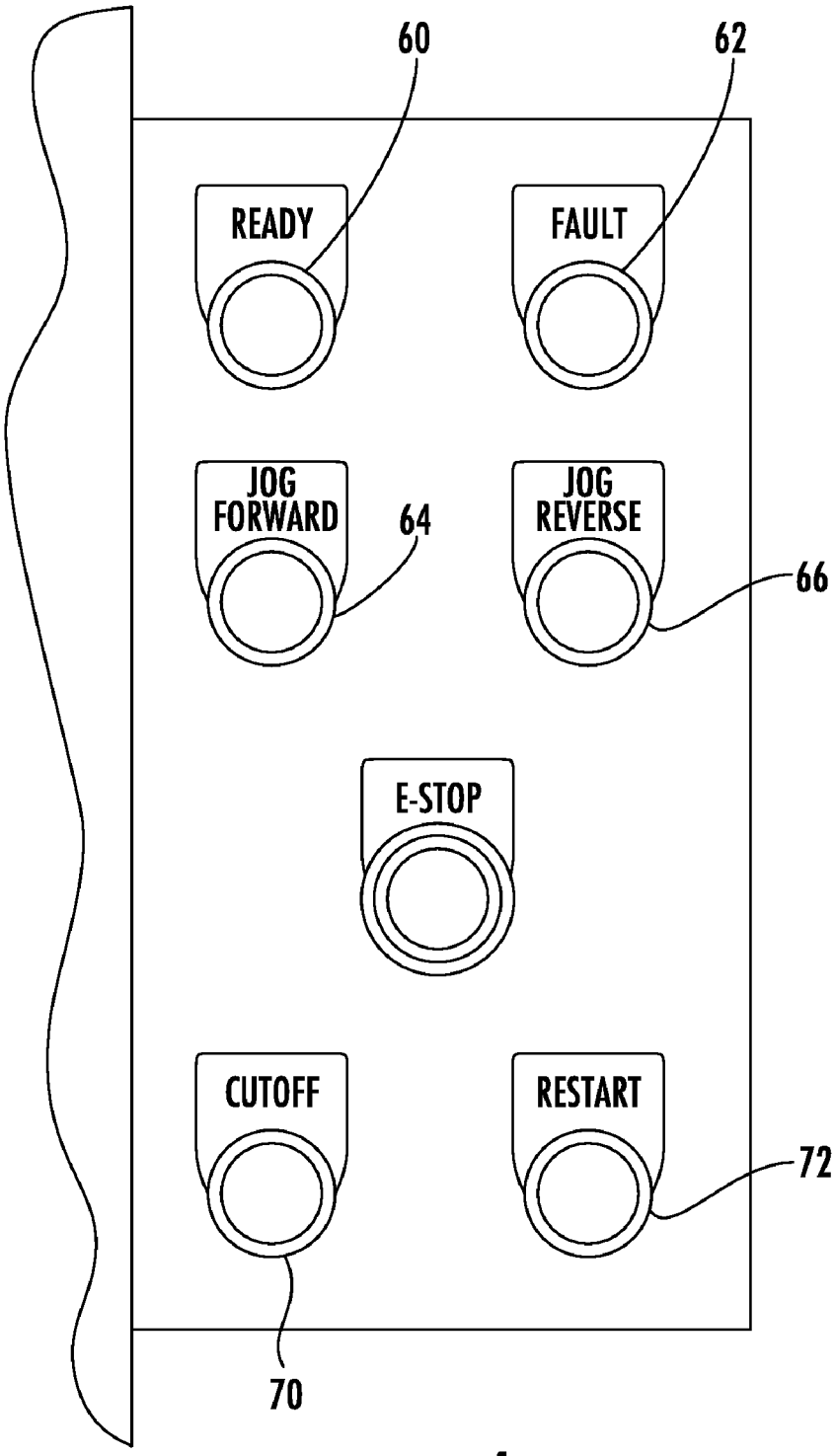
FIG. 4 is a top view of the controller of FIG. 1 illustrating control activators and indicators.

Referring now to FIG. 4 a top view of the controller 42 is shown. The controller 42 comprises an internal processing unit and communications hardware (not shown) for controlling and communicating with the data input device 16, the dispensing device 12, the printer 26, and the display 34, and includes control actuators and process indicators for the operator. The control actuators include a cut-off button 70 which allows the operator to manually control the cutter shear 52, a restart button 72 to restart the control process after a fault, a jog forward button for manually jogging inner protective wrapping material 14 through the dispensing device 12, and a jog reverse button 66 for jogging the inner protective wrapping material 14 through the dispenser 12 and back towards the container 46 as, for example, to clear a jam. The indicators include a fault light 62 indicating that the dispensing device 12 has entered a fault condition, and a ready light 60, indicating that all faults have been cleared and that the dispensing device 12 is ready to dispense inner protective materials 14. Fault conditions can include, for example, a condition in which a jam has been detected by the jam detector 54, an out-of-material condition as detected by the senor 48, or an emergency stop condition. To provide the emergency stop, the controller 42 further includes an E-stop actuator 68 which can be activated to stop the feeding process in an emergency. Additional E-stops can be provided elsewhere in the system and connected to the controller 42, and particularly can be provided in conjunction with a touch screen when a touch screen is used as the display 34.

Figure 5:
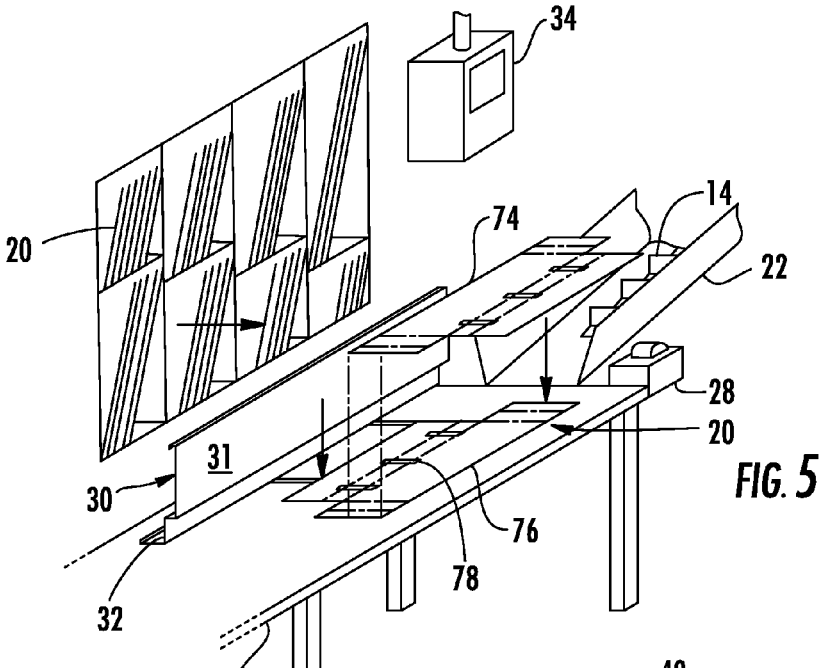
FIG. 5 is a perspective view illustrating positioning panels for providing an outer protective packaging material as positioned on the folding table of FIG. 1.

Referring now to FIG. 5, after size data for the product 40 is entered into the data entry device 16, a box size indicator can be provided on the display 34, which can be, as described above, a touch screen capable of data entry or a simple display. Based on the indicator, the operator selects an adjustable-size outer protective packaging material 20 from among a plurality of possible sized devices which can be, as shown, stored in a single rack 23. The adjustable size outer protective packaging material 20 here comprises two panels 74 and 76 which can be telescoped together to adjust the size to the product 40 to be packaged, and are preferably constructed of a corrugated cardboard material, although various other types of cardboard, paperboard, and similar materials could also be used. Each of the panels 74 and 76 include slots 78 for receiving a binder or banding material 82 (FIG. 11) as described below, and further includes a plurality of scored or creased bend lines, which allow for easily folding the outer protective packaging material 20 around the product 40. The protective panels 74 and 76 can be "telescoped" longitudinally to adjust to various lengths of panel products 40, as described below. The lateral dimension of the panels 74 and 76, however, is fixed, so the lateral dimension of the product 40 wrapped in inner protective packaging material 16 is less than or equal to the lateral dimension of the panels 74 and 76. If less, there will be a lateral air space between the wrapped product 40 and at least one sidewall of the outer protective packaging material 20, with the product 40 wrapped in inner protective packaging material 16 supported by the binder 82.

The panels 74 and 76 are positioned adjacent one another on the folding table 18, which includes a surface lined with ultra high modular weight polyethylene to prevent abrasion to the product 40. The legs of the folding table 18 are also preferably adjustable allowing the table to be adjusted to the height of the operator.

Figure 11:
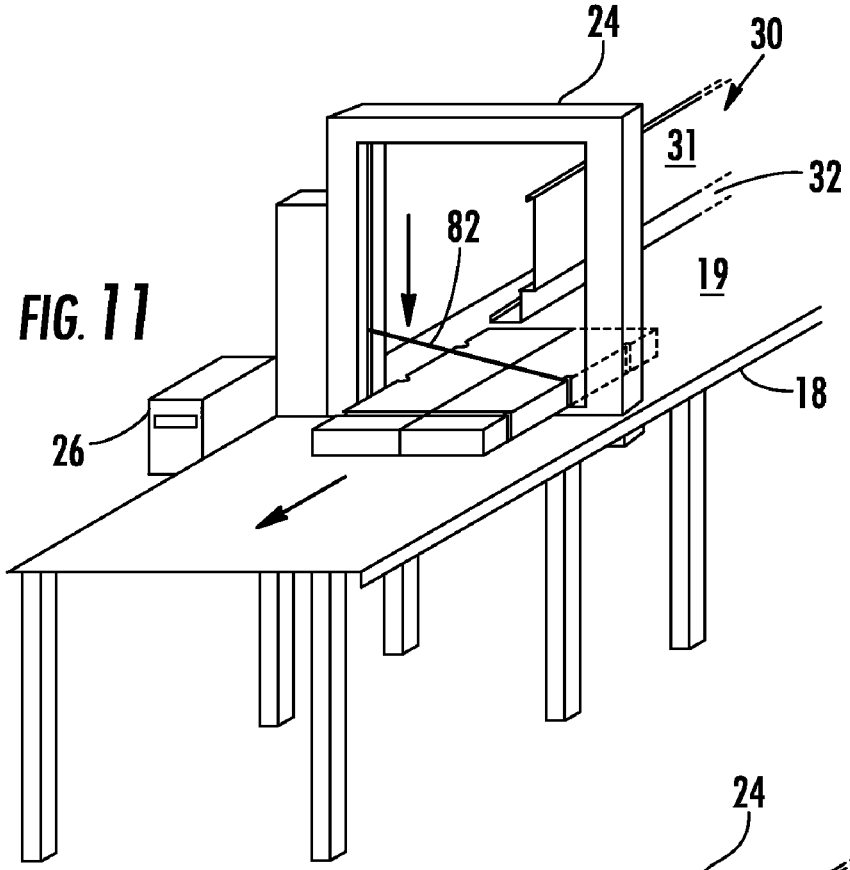
FIG. 11 is a perspective view of the package as a binder is applied by the binding device of FIG. 1.
Figure 13:
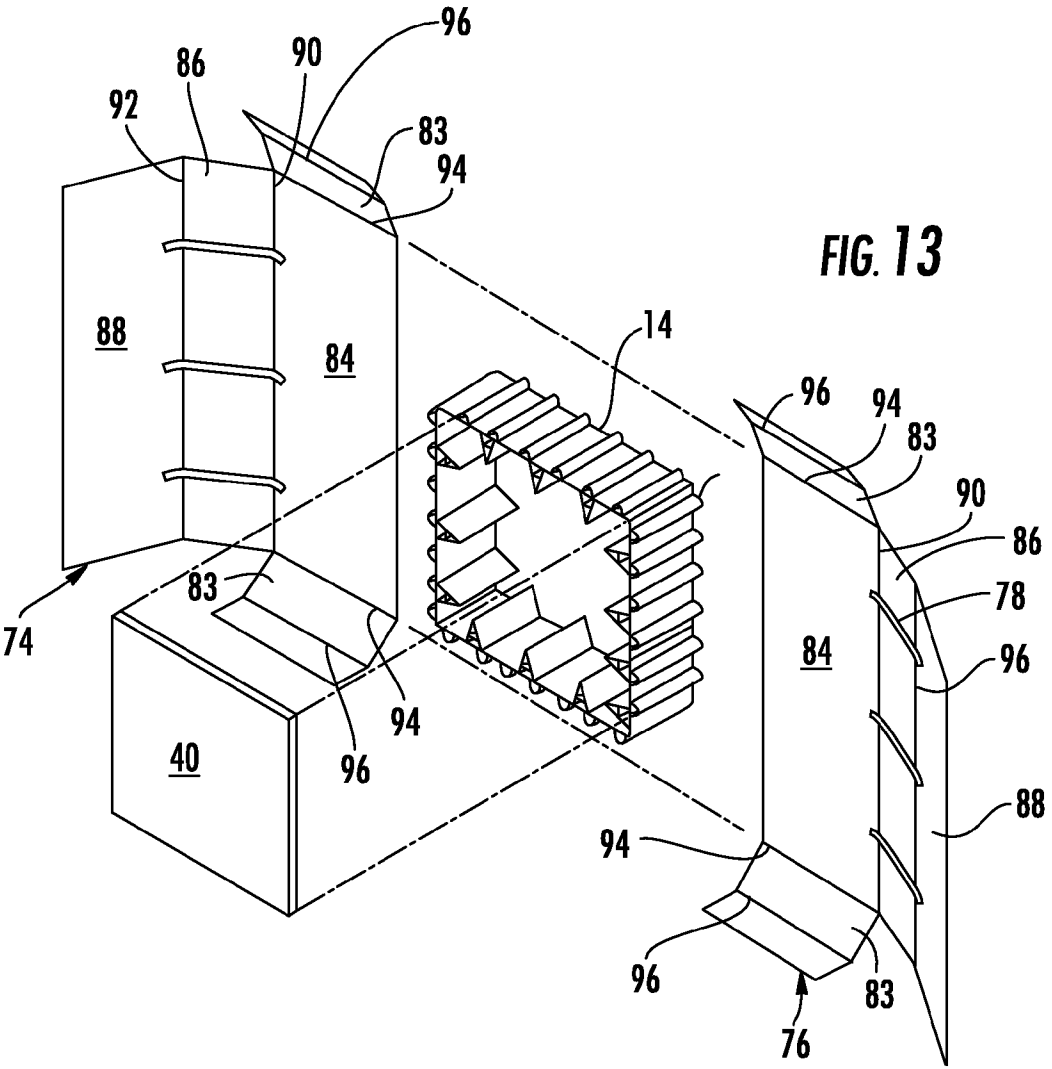
FIG. 13 is an exploded view of a wrapped product illustrating the constituent parts.

Referring now to FIG. 13, and exploded view of the panels 74 and 76 as provided around the package 40 and inner protective wrapping material 14 is shown. Each of the panels 74 and 76 includes both a back portion 84, a front portion 88, a side portion 86, and flaps 83 extending from opposing ends of each back portion 84. The back portion 84 is separated from the side portion 86 by a first crease line 90 and the side portion 86 is separated from the front portion 88 by a second crease line 92. A third crease line 94 separates the flap 83 from the back portion 84, while a fourth crease line 96 is provided in the flap 83 to allow the flap 83 to be folded, as described below. As described above, each of the panels 74 and 76 further comprises slots 78, which are die cut or otherwise formed in the panels 74 and 76 in pairs on the side portions 86 of the panels 74 and 76 to receive a binder 82 (FIG. 11). The slots 78 extend across the width of each side portion 86 and can extend into portions of each of the back portion 84 and front portion 88. As described below, the panels 74 and 76 are slid toward one another on the table 18 to adjust the size of the outer packaging material 20 to the package 40.

Figure 6:
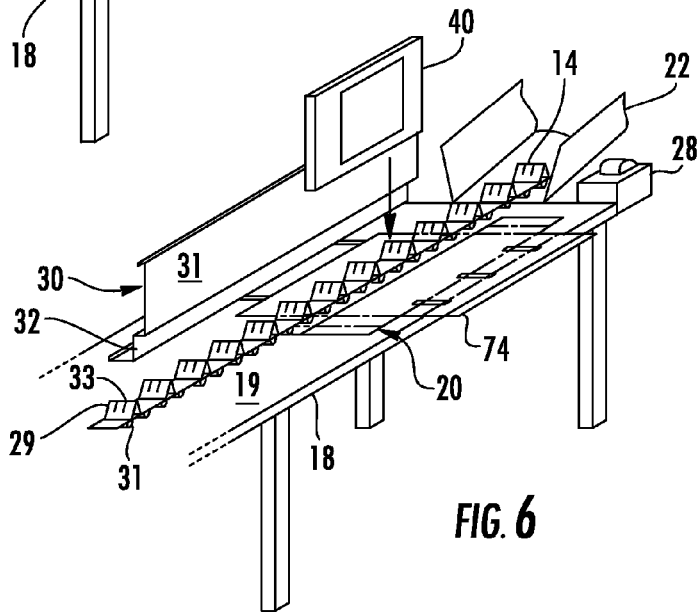
FIG. 6 is a perspective view of the folding table of FIG. 1 illustrating a process step of positioning a product within inner protective wrapping material on the folding table.

Referring now to FIG. 6, after a length of the inner protective wrapping material 14 is dispensed by the dispensing device 12, the inner protective packaging material 14 is fed to the folding table 18 through the chute 22, and the flat panel product 40 is inserted onto the inner protective packaging material 14 between a pair of slits 33 provided in the inner protective packaging material 14. The inner protective packaging material 14 is preferably a suspension wrap material which includes A-shaped slots 29 which receive the flat panel product 40 within the slits 33 and semi-circular corrugations 31 which extend radially from the opposing side. As can be seen here, the corrugations 31 are directed radially outward away from the flat panel product 40 toward the outer protective packaging material 20. The A-shaped slots 29 are directed inward, and the side edges of the inner protective packaging material 16 are laterally spaced from opposing faces of the flat panel product 40 so as to create a protected air space on each side of the flat panel product between the face of the product and a plane defined by the adjacent side edges of the packaging material. The air space protects the panel product 40 from a force or pressure applied to the front and/or back of the panel product 40. Suitable suspension wrap materials are commercially available from the SUS-RAP Division of the Menasha Corporation in Danville, Va. under the trade name SUS-RAP® or POLYSUS-RAP®. The POLY SUS-RAP® includes an internal poly lining which, when placed in contact with the product 40, prevents abrasion.

Figure 7:
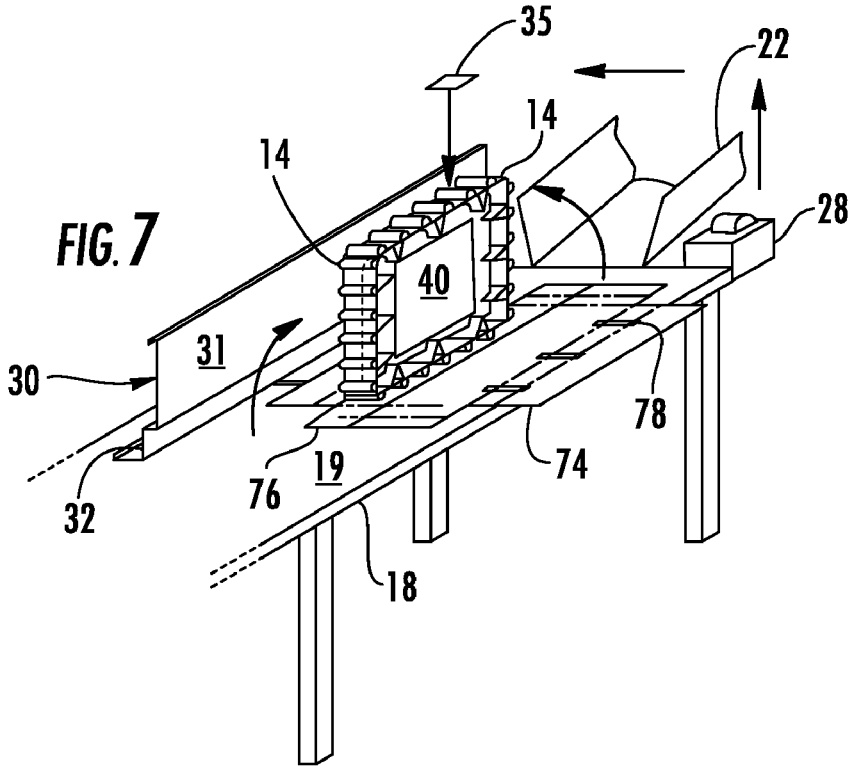
FIG. 7 is a perspective view of the folding table of FIG. 1 illustrating a process step for wrapping the product within the inner protective wrapping material.

Referring now to FIG. 7, after the inner protective wrapping material 14 is folded around the circumference of the outer edge of the flat panel product 40, a piece of tape 35 from a tape dispenser 28 mounted adjacent the folding table 18 is adhered to the inner protective wrapping material 14 to retain the inner protective wrapping material 14 in position, protecting the edges of the product 40.

Figure 8:
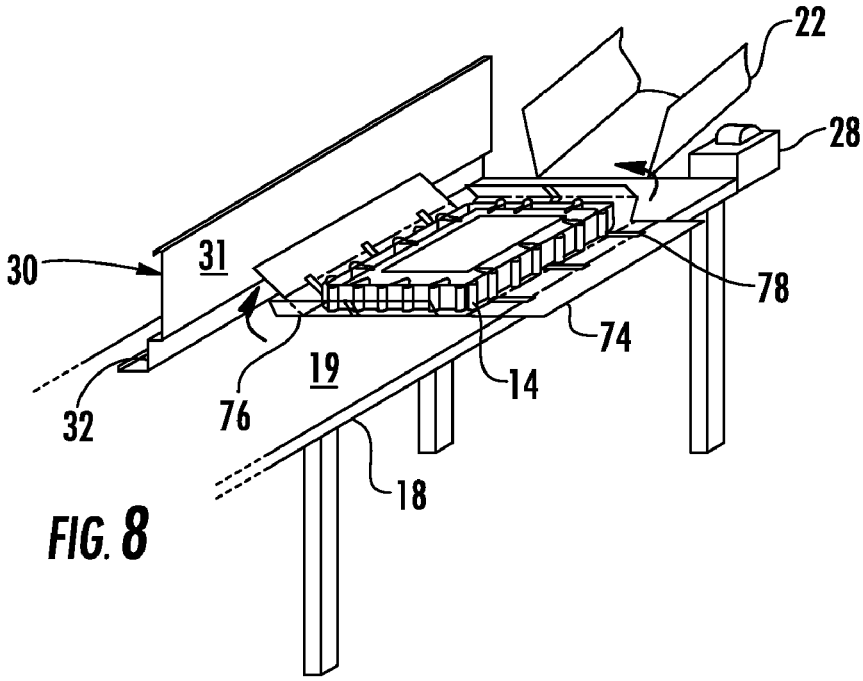
FIG. 8 is a perspective view of the folding table of FIG. 1 illustrating a first step in a folding process for folding the outer protective packaging material over the product.

Referring now to FIG. 8, after the flat panel product 40 is wrapped in the inner protective wrapping material 14, the wrapped panel product 40 is then positioned on the panels 74 and 76, which are arranged with their respective back portions 84 adjacent each other, and with the back portion 84 of one of the panels 74 and 76 overlapping the back portion 84 of the other of the panels 74 and 76. To adjust the size of the outer protective packaging material 20, the back 84 of the one of the panels 74 and 76 is slid over the back 84 of the opposing panel 74 or 76 until the side portions 86 each abut the inner protective packaging material 14.

Figure 14:
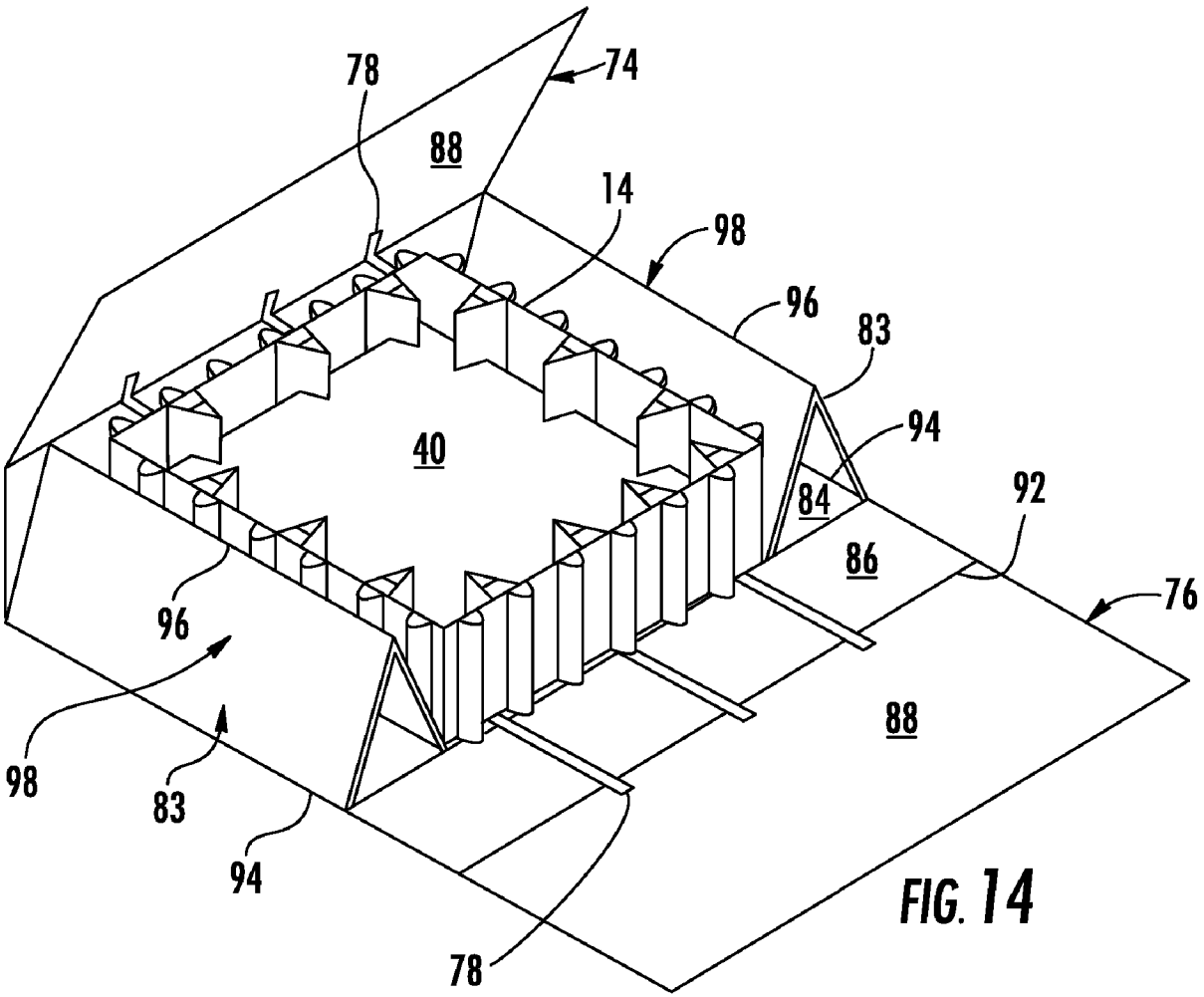
FIG. 14 is a perspective view of the product being wrapped in the outer protective material illustrating the folding process.

When the relative position of the panels 74 and 76 are sized for the panel product 40, the flaps 83 are folded along the crease line 96 to form, as shown in FIG. 14, a triangular wall 98, the base of the triangle being provided by the back portion 84 of the panels 74 and 76, and the walls provided by the folded flaps 83. The wall 98 can be adjusted to the size of the wrapped panel product 40, and protects the panel product 40 from the side. Although shown in a triangular shape, it will be apparent that additional crease lines can be provided to provide a rectangular or other shaped wall.

Figure 9:
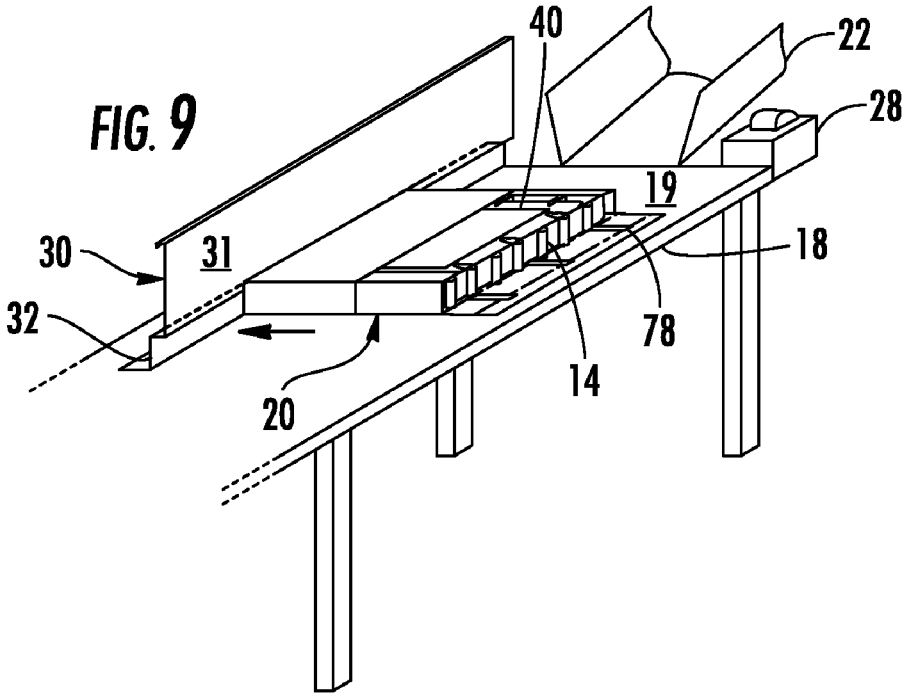
FIG. 9 is a perspective view of the folding table of FIG. 1 as the package of FIG. 8 is forced into the folding channel.
Figure 10:
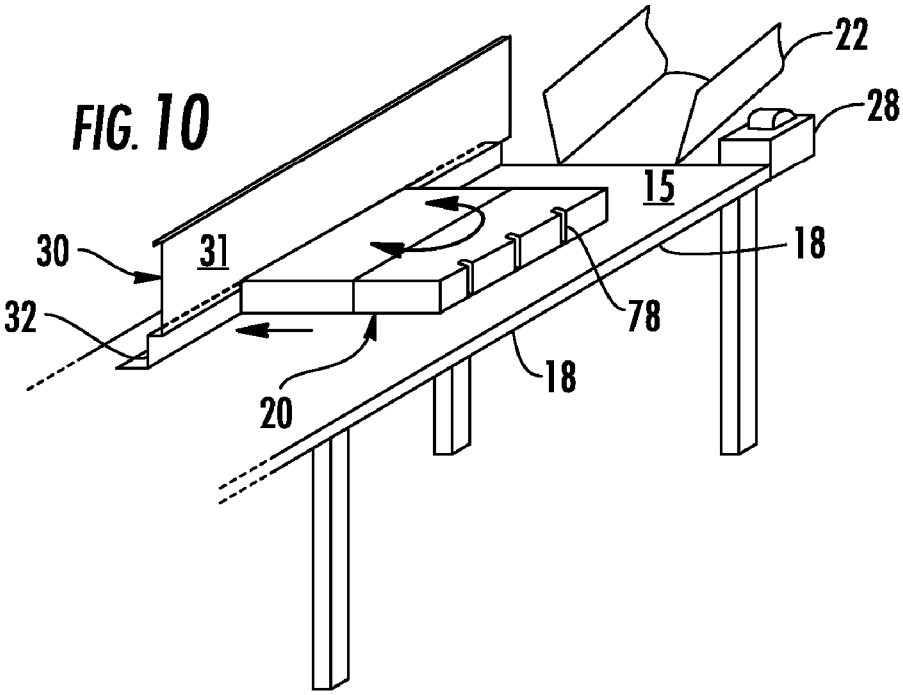
FIG. 10 is a perspective view of the folding table as the package is rotated and the opposing side is folded.

To enclose the flat panel product 40 within the outer protective packaging material 20 the product 40 is then slid in the direction of a backstop 30 extending vertically upward and substantially perpendicular to the folding table 18. The backstop 30 includes a flat folding portion 31 substantially perpendicular to the top of the table 18 and is connected to the top 19 of the table 18 by a folding channel 32, constructed in an inverted L-shape with the distance from the top 19 of the table 18 to the base of the inverted L-shaped section of the folding channel 32 to be sized and dimensioned slightly larger than the flat panel product 40 as wrapped in the outer protective wrapping material 20. To fold the front portion 88 of the panels 74 and 76 of the outer protective wrapping material over the wrapped panel product, the product 40 and protective wrapping material 20 are slid toward the folding channel 32 with the front portion 88 directed upward away from the top 19 of the table 18 such that, as product is slid against the backstop 30, the flat folding portion 31 forces the front portion of the panel 74 or 76 adjacent the backstop 30 over and onto the flat panel product 40 as the product moves into the channel 32 as shown in FIG. 9. The product 40 and front portion 88 fit into the channel 32, such that the front portion 88 is folded onto the product 40. The wrapped product 40 and outer protective packaging material 20 are then rotated in the opposite direction and forced against the backstop 30 to fold the front flap 88 from the opposing panel 74 or 76 over the product 40. When the outer protective packaging material 20 encloses the wrapped product 40, the slots 78 are exposed in a parallel configuration along two adjacent sides of the product.

Referring now to FIG. 11, when the wrapped product 40 is enclosed in the outer protective packaging material 20, the product is moved under the binding device 24. As shown here, the binding device 24 is a banding machine for providing a plastic banding binder 82 through the slots 78 in the package, to bind the outer protective packaging material 20 and the inner protective packaging material 14 to the flat panel product 40. The wrapped product 40 is aligned under the binding device 24 with the slots 78 positioned to receive banding, and is activated by a foot pedal or other activator device. Plastic banding is provided through each of three sets of slots 78 formed in a parallel configuration to each other on opposing sides of the wrapped flat panel product 80. The binder 82 is wrapped longitudinally around the outer packaging material 20 and received in the slots 78 to supportively engage the inner protective packaging material 16 in the slots 78 and to laterally support the inner protective packaging material 16 and flat panel product 40 within the outer protective packaging material 20. The binding 82 therefore suspends the inner protective packaging material 16 and the product 40 relative to at least one wall of the size adjustable outer packaging material 20. The binder 82 therefore retains the inner protective material 14 and the outer protective material 20 around the circumference of the panel product 40 and supports the wrapped product 40 within the package, and suspended from the edges.

Figure 12:
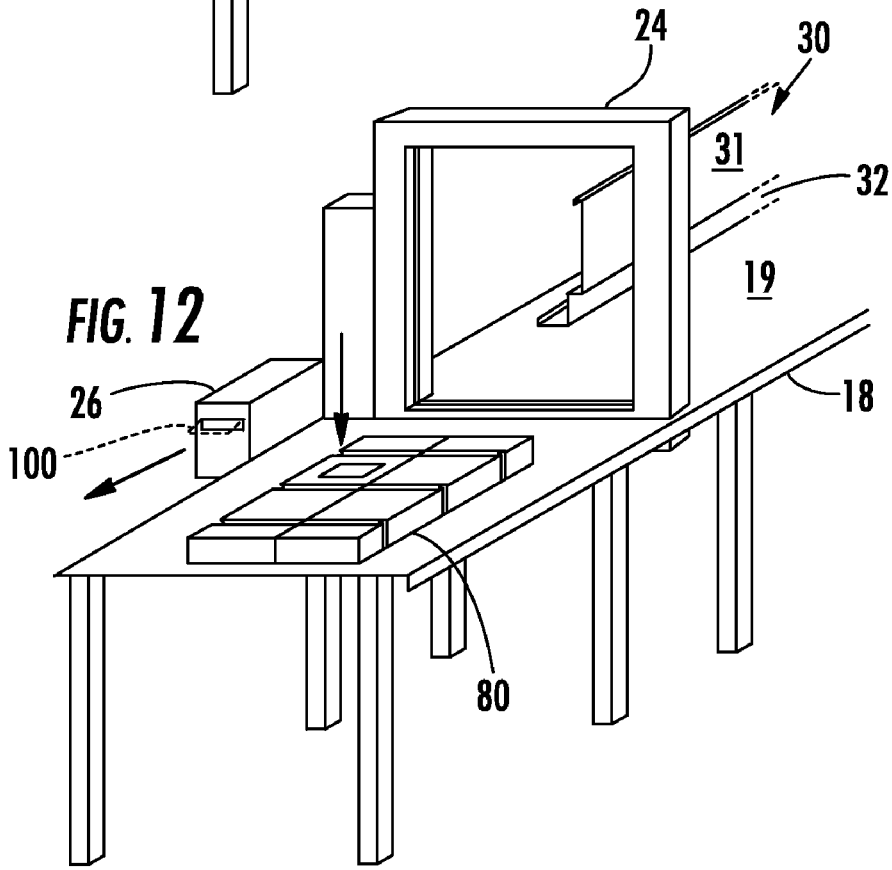
FIG. 12 is a perspective view of the packaging system illustrating the printer of FIG. 1 printing a shipping label which is placed on the package.

Referring now to FIG. 12, after the product is wrapped, a shipping label 100 is retrieved from the shipping label printer 26 and adhered to the wrapped package 80. An outer shipping package, constructed of cardboard, paperboard, or corrugated materials can also be provided. After completion of the process, the barcode or other data label can again be scanned, or data otherwise entered onto a data entry device 14, to provide a signal to the controller 42 that the process is complete. The controller 42 can be connected to other factory automation devices to provide a count of the number of types and product 40 that have been packaged, customer shipping labels, to maintain stock levels, and for other data.

The present invention therefore provides a substantially automated packaging system which decreases the time required for packaging a product, while providing improved packaging and decreased damage to products during the shipping process. The manual portions of the process, and particularly the folding table 18, are designed to enable operators to perform efficiently, and with improved ergonomics. The process, for example, provides an improved method for folding a box which relies substantially on equipment rather than manual operating of the operator to provide the majority of force, eliminates the need for ergonomically difficult processes such as the use of tape guns, decreases the amount of bending and lifting required by the operator, and further reduces the weight of the packaging and the packaged product, decreasing the strain on the operator.

The packaging shown and described also provides improved protection from damage by providing an air cell around the perimeter of the product to protect the product from damage due to drops and vibration during shipment. Because the outer packaging 20 can be telescoped to the appropriate size for the panel 40, inventory of packaging can be significantly reduced. The weight of the packaging is also reduced as compared to prior art packaging, reducing shipping cost. The packaging as described has been further shown to be effective in meeting shipping standards of the International Safe Transit Association Testing.

Although a specific embodiment of the present invention has been shown and described above, it will be apparent that a number of variations can be made within the scope of the invention. For example, although the binding device 24 has been shown and described as a stand-alone, manually operated device, it will be apparent that various automated devices could be tied to the controller for selecting a binder size, for monitoring the binding process, and for dispensing binders. Various types of dispensers, data entry devices, and controller systems will also be apparent to those of skill in the art. Additionally, although a specific suspension wrap material is described above, a number of similar suspension wrap products, also commercially available from the Menasha Corporation, can also be used. Furthermore, various other resilient and/or shock-absorbing protective materials including but not limited to foam, plastic, rubber, corrugated build-ups, corrugated die cuts, and other materials can also be used.

Furthermore, although the binder 82 is described above as a plastic banding material, various other adhesive devices including glue, tape, cinch-staples, stretch wrap, press seals, and other devices could also be used. Similarly, although the outer protective packaging 20 is described above as corrugated paperboard, corrugated plastic, laminated fiberboard, sheet plastic, shrink wrap, single face corrugated paper, and various other materials could also be used.

Additionally, a number of different types of flat panel products can be packaged as described including windows, glass, plastic, mirrors, composite materials, granite, entrance doors, shutters, shower doors, medicine cabinets, industrial cabinets, picture frames, glass, circuit board and similar products and devices.

While there has been shown and described what are at present considered the preferred embodiments of the invention, it will be obvious to those skilled in the art that various changes and modifications can be made therein without departing from the scope of the invention defined by the appended claims.

What is claimed is:

1. A method for packaging a flat panel product, the method comprising the following steps:

providing a folding table having a stop surface with a rearward portion and a backstop extending upwardly from the rearward portion of the top surface, said backstop having a folding channel formed thereon;

determining a size of a flat panel product having an outer edge, front surface and back surface;

selecting a corrugated edge protection material based on the size of the outer edge of the flat panel product;

wrapping the corrugated edge protection material around the outer edge of the flat panel product forming a wrapped flat panel product;

selecting a size adjustable outer protective material to enclose the wrapped flat panel product;

positioning the wrapped flat panel product within the outer protective material and adjusting the outer protective material to the size of the wrapped flat panel product;

forcing the wrapped flat panel product and the outer protective material against the folding channel of the backstop at least once causing the outer protective material to fold over the wrapped flat panel product; and providing a binder around the outer protective material to limit movement of the flat panel product within the corrugated edge protection material and outer protective material during storage and shipping.

2. The method as defined in claim 1, further comprising the step of providing slots in the sides of the outer protective material, the slots being sized and dimensioned to receive the binder.

3. The method as defined in claim 1, wherein the step of providing a binder comprises strapping at least one plastic band around the outer protective material.

4. The method as defined in claim 1, wherein the size-adjustable outer protective material comprises a telescoping box including a first panel and a second panel, and the step of adjusting the size comprises positioning the first panel relative to the second panel to adjust a dimension of the telescoping box to the size of the wrapped flat panel product.

5. The method as defined in claim 1, further comprising the step of entering data indicative of the size of the flat panel product and automatically dispensing a length of corrugated edge protection material based on the size.

6. The method as defined in claim 1 further comprising the step of providing at least one slit sized and dimensioned to receive the outer edge of the flat panel product in a side of the corrugated edge protection material.

7. The method as defined in claim 5, further comprising the step of cutting the length of corrugated edge protection material to the size of the outer edge of the flat panel product.

8. The method as defined in claim 1, further comprising the step of providing a data label indicating a size of the product on the flat panel product.

9. The method as defined in claim 1, further comprising the step of providing a shipping label to the outer protective material on the flat panel product.

10. A method for packaging a flat panel product, the method comprising the following steps:

providing a folding table having a stop surface with a rearward portion and a backstop extending upwardly from the rearward portion of the top surface, said backstop having a folding channel formed thereon;

determining a size of a flat panel product having an outer edge, front surface and back surface;

dispensing a length of a corrugated edge protection material based on the size of the outer edge of the flat panel product;

cutting the length of corrugated edge protection material to the size of the outer edge of the flat panel product;

wrapping the corrugated edge protection material around the outer edge of the flat panel product forming a wrapped panel product;

selecting a size adjustable outer protective material to enclose the wrapped flat panel product;

positioning the wrapped flat panel product within the outer protective material and adjusting the outer protective material to the size of the wrapped flat panel product;

forcing the wrapped flat panel product and the outer protective material against the folding channel of the backstop at least once causing the outer protective material to fold over the wrapped flat panel product; and providing a binder around the outer protective material to limit movement of the flat panel product within the corrugated edge protection material and outer protective material during storage and shipping.

11. The method as defined in claim 10, further comprising the step of providing slots in the sides of the outer protective material, the slots being sized and dimensioned to receive the binder.

12. The method as defined in claim 10, wherein the step of providing a binder comprises strapping at least one plastic band around the outer protective material.

13. The method as defined in claim 10, wherein the size-adjustable outer protective material comprises a telescoping box including a first panel and a second panel, and the step of adjusting the size comprises positioning the first panel relative to the second panel to adjust a dimension of the telescoping box to the size of the wrapped flat panel product.

14. The method as defined in claim 10, further comprising the step of providing at least one slit sized and dimensioned to receive the outer edge of the flat panel product in a side of the corrugated edge protection material.

15. The method as defined in claim 10, further comprising the step of providing a data label indicating a size of the product on the flat panel product.

16. The method as defined in claim 10, further comprising the step of providing a shipping label to the outer protective material on the flat panel product.

* * * * *